US010294051B2

(12) United States Patent
Huang et al.

(10) Patent No.: US 10,294,051 B2
(45) Date of Patent: May 21, 2019

(54) SINGLE CARD SEPARATION APPARATUS AND CARD DISTRIBUTION DEVICE

(71) Applicant: GRG BANKING EQUIPMENT CO., LTD., Guangzhou, Guangdong (CN)

(72) Inventors: Weiquan Huang, Guangdong (CN); Xuewei Xie, Guangdong (CN); Zeyan Guan, Guangdong (CN); Yun Lei, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/538,383

(22) PCT Filed: Aug. 24, 2015

(86) PCT No.: PCT/CN2015/087897
§ 371 (c)(1),
(2) Date: Jun. 21, 2017

(87) PCT Pub. No.: WO2016/110107
PCT Pub. Date: Jul. 14, 2016

(65) Prior Publication Data

US 2018/0037427 A1 Feb. 8, 2018

(30) Foreign Application Priority Data

Jan. 5, 2015 (CN) ..... 2015 1 0008038

(51) Int. Cl.
*B65H 3/06* (2006.01)
*B65H 7/02* (2006.01)
(Continued)

(52) U.S. Cl.
CPC ..... *B65H 3/0684* (2013.01); *B65H 1/04* (2013.01); *B65H 3/06* (2013.01); *B65H 3/0661* (2013.01);
(Continued)

(58) Field of Classification Search
CPC combination set(s) only.
See application file for complete search history.

(56) References Cited

U.S. PATENT DOCUMENTS 3,680,855 A * 8/1972 Brown ..... G06K 13/10 271/112
5,377,970 A * 1/1995 Kikuchi ..... B65H 3/5223 271/117
(Continued)

FOREIGN PATENT DOCUMENTS

CN 101593371 A 12/2009
CN 101635064 A 1/2010
(Continued)

OTHER PUBLICATIONS

International Search Report for PCT/CN2015/087897 , dated Nov. 18, 2015, ISA/CN.
(Continued)

*Primary Examiner* — Thomas A Morrison
(74) *Attorney, Agent, or Firm* — Yue (Robert) Xu; Apex Attorneys at Law, LLP

(57) ABSTRACT

A device for separating cards in single sheet includes: a support frame, and a driving shaft movably mounted on the support frame, a separating wheel being provided on the driving shaft. The driving shaft is movable freely up and down on the support frame, and an elastic component is provided between the driving shaft and the support frame. The elastic component has one end fixed to the support frame, and another end mounted on the driving shaft, which allows the separating wheel to always keep a downward pressure to cards under the action of an elastic force. The elastic component in contact with the driving shaft provides downward pressure to the driving shaft, thus the separating
(Continued)

wheel always keeps downward pressure to the cards under the action of the elastic force.

8 Claims, 5 Drawing Sheets

(51) Int. Cl.
*B65H 1/04* (2006.01)
*B65H 29/20* (2006.01)
*B65H 43/00* (2006.01)

(52) U.S. Cl.
CPC ..... *B65H 7/02* (2013.01); *B65H 29/20* (2013.01); *B65H 43/00* (2013.01); *B65H 2402/54* (2013.01); *B65H 2404/152* (2013.01); *B65H 2404/1523* (2013.01); *B65H 2404/1526* (2013.01); *B65H 2701/1914* (2013.01)

(56) References Cited

U.S. PATENT DOCUMENTS

| | | | | |
|---|---|---|---|---|
| 6,039,314 | A | 3/2000 | Miller et al. | |
| 6,315,283 | B1 | 11/2001 | Haas et al. | |
| 8,459,635 | B2 * | 6/2013 | Inoue | B65H 3/0607 271/117 |
| 8,651,477 | B2 * | 2/2014 | Chiba | B65H 3/0684 271/126 |
| 9,221,635 | B2 | 12/2015 | Kosuga | |

FOREIGN PATENT DOCUMENTS

| | | | |
|---|---|---|---|
| CN | 202771448 | U | 3/2013 |
| CN | 103129991 | A | 6/2013 |
| CN | 203021068 | U | 6/2013 |
| CN | 104008406 | A | 8/2014 |
| CN | 104495431 | A | 4/2015 |
| FR | 2849006 | A1 | 6/2004 |
| JP | 2010265087 | A | 11/2010 |
| WO | 2008010321 | A1 | 1/2008 |
| WO | 2012176478 | A1 | 12/2012 |

OTHER PUBLICATIONS

The European Search Report dated Mar. 1, 2018 for European Patent Application No. 15 876 609.7.

* cited by examiner

SINGLE CARD SEPARATION APPARATUS AND CARD DISTRIBUTION DEVICE

This application is the national phase of International Application No. PCT/CN2015/087897, titled "SINGLE CARD SEPARATION APPARATUS AND CARD DISTRIBUTION DEVICE", filed on Aug. 24, 2015 which claims the benefit of priority to Chinese Patent Application No. 201510008038.8, titled "DEVICE FOR SEPARATING CARDS IN SINGLE SHEET AND CARD DISPENSING DEVICE", filed with the Chinese State Intellectual Property Office on Jan. 5, 2015, the entire disclosures of which applications are incorporated herein by reference.

TECHNICAL FIELD

The present application relates to the technical field of card dispensing, and particularly to a device for separating cards in single sheet and a card dispensing device.

BACKGROUND

In subways, parking lots, freeways and other places where traffic is heavy, generally, cards such as IC cards are dispensed to facilitate flowing of the traffic. As a large number of cards are to be processed everyday, an automatic card dispensing device is developed to save manpower resources and improve trading efficiency. The automatic card dispensing device should have a high reliability, otherwise, a serious congestion may occur once the automatic card dispensing device malfunctions.

In the automatic card dispensing device, one of the key components is a card separating mechanism installed on a card storing box. The card separating mechanism is mainly composed of the following two parts: a card picking mechanism which pushes a card forward by a static frictional force generated when the card picking mechanism is in contact with the card surface; and a card dispensing mechanism in which a card passage is formed by a guide plate and an adjustment plate to allow the card pushed by the card picking mechanism to smoothly pass through till the card is completely sent out. In operation, the card separating mechanism cycles the above process till all the cards are sent out. The conventional card separating mechanisms mainly adopt two operation manners. One is mechanical separation by which a card is pushed by reciprocating motion of a scraper and is separated from the card storing box by taking a tail end of the card as a point where a force is applied. However, in this manner, the surface of the card may be abraded due to the reciprocating motion of the scraper. Another way is friction separation by which a card is separated from a card storage box by a friction between a rubber wheel and the card. In this manner, the rubber wheel is fixed at an up and down position, thus in the case that multiple cards are stacked and inclined, a gap may be generated between the rubber wheel and the uppermost card, therefore, it is difficult to ensure sufficient contact between the rubber wheel and the card and a success rate of card dispensing as well.

SUMMARY

A device for separating cards in single sheet is provided according to an embodiment of the present application, which addresses the technical issue that sufficient contact between a rubber wheel and cards is difficult to be ensured due to a gap between the rubber wheel and the cards generated when a conventional card separating mechanism separates multiple stacked and tilted cards, and addresses the technical issue that the surface of the card may be abraded by reciprocate of a scraper in a conventional mechanical card separating mechanism.

A device for separating cards in single sheet includes: a support frame, and a driving shaft movably mounted on the support frame, a separating wheel being provided on the driving shaft. The driving shaft is movable freely up and down on the support frame, and an elastic component is provided between the driving shaft and the support frame. The elastic component has one end fixed to the support frame, and another end mounted on the driving shaft, which allows the separating wheel to always keep a downward pressure to cards under the action of an elastic force.

Optionally, the separating wheel is driven by rotation of the driving shaft, and a relative rotational gap with a preset angle range exists between the separating wheel and the driving shaft.

Optionally, the support frame is provided with a vertical elongated slot in which the driving shaft is moved up and down.

A card dispensing device according to an embodiment of the present application includes:

the device for separating cards in single sheet according to any one of the embodiments of the present application, wherein the device for separating cards in single sheet includes the support frame, the separating wheel, the driving shaft and the elastic component; and a transmission mechanism including an upper position-limiting component and a lower position-limiting component which are mounted on the support frame, wherein the upper position-limiting component and the lower position-limiting component are vertically opposite to each other, and a card dispensing gap which is larger than a thickness of a single card and smaller than a thicknesses of two cards is defined between the upper position-limiting component and the lower position-limiting component.

Optionally, the upper position-limiting component is fixedly mounted on the support frame and the lower position-limiting component is movably mounted on the support frame.

Optionally, the upper position-limiting component is fixedly or movably mounted on the support frame, and the lower position-limiting component is fixedly mounted on the support frame.

Optionally, the card dispensing device further includes:

a swing lever mounted on the support frame and configured to detect a height position of stacked cards, specifically, a detecting point of the swing lever is located in the middle of the cards in a direction of a short side of the card;

a first sensor mounted in front of the support frame and arranged to correspond to a front end of the swing lever, and configured to detect a baffle at a front end of the swing lever; and a raising component arranged below the stacked cards and is electrically connected to the first sensor.

Optionally, in the case that the baffle at the front end of the swing lever is not detected by the first sensor, the raising component is triggered by the first sensor to raise the stacked cards up till the baffle at the front end of the swing lever is detected by the first sensor, and then the raising component stops raising.

Optionally, the card dispensing device further includes:

a conveying mechanism including a pair of conveying wheels mounted on the support frame to be vertically opposite to each other and a second sensor, wherein the second sensor is mounted on the support frame and is configured to detect the position of a separated card.

Optionally, when the card dispensing device is started, the driving shaft, under the action of a driving motor and a pin, drives the separating wheel to horizontally convey, under the action of a friction, an uppermost card at the top of stacked cards forward to the card dispensing gap between the upper position-limiting component and the lower position-limiting component, and the uppermost card continues to be conveyed forward by the conveying wheels, till leaving of a tail end of the card is detected by the second sensor, the conveying wheels then stop rotating.

As described in the above technical solutions, the embodiments of the present application have the following advantages.

The device for separating cards in single sheet and the card dispensing device are provided according to the embodiments of the present application. The device for separating cards in single sheet includes the support frame, and the driving shaft movably mounted on the support frame, and the separating wheel is provided on the driving shaft. The driving shaft is movable freely up and down on the support frame, and the elastic component is provided between the driving shaft and the support frame, and the elastic component has one end fixed to the support frame, and another end mounted on the driving shaft, which allows the separating wheel to always keep the downward pressure to cards under the action of an elastic force. In the embodiments of the present application, the elastic component in contact with the driving shaft provides downward pressure to the driving shaft, such that the separating wheel always keeps downward pressure to the cards under the action of the elastic force, thus achieving the function that an upper surface of the cards keeps in full contact with the separating wheel all the time when the cards are in any tilted state, and addressing the technical issue that sufficient contact between a rubber wheel and cards is difficult to be ensured due to a gap between the rubber wheel and the cards generated when a conventional card separating mechanism separates multiple stacked and tilted cards, and further ensuring the success rate of the card dispensing. Further, the separating wheel is employed to separate cards by means of friction, thus addressing the technical issue that the surface of a card may be abraded by reciprocation of a scraper in a conventional mechanical card separating mechanism.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

REFERENCE NUMERALS IN FIGURES

| | |
|---|---|
| 1 separating wheel, | 2 driving wheel, |
| 3 pin, | 4 support frame, |
| 5 swing lever, | 6 first sensor, |
| 7 lower position-limiting component, | 8 upper position-limiting component, |
| 9 conveying wheel, | 10 second sensor, and |
| 11 elastic component. | |

DETAILED DESCRIPTION OF THE EMBODIMENTS

A device for separating cards in single sheet is provided according to an embodiment of the present application, which addresses the technical issue that sufficient contact between a rubber wheel and cards is difficult to be ensured due to a gap between the rubber wheel and the cards generated when a conventional card separating mechanism separates multiple stacked and tilted cards, and addresses the technical issue that the surface of the card may be abraded by reciprocation of a scraper in a conventional mechanical card separating mechanism.

In order to make the objects, features, and advantages of the present application more obvious and easier to be understood, the technical solutions of embodiments of the present application will be clearly and completely described hereinafter in conjunction with the drawings of the embodiments of the present application. Apparently, the embodiments described below are only some examples of the present application, rather than all implementations. Other embodiments obtained by those skilled in the art based on the embodiments of the present application without any creative efforts all fall into the scope of the present application.

Figure 1:
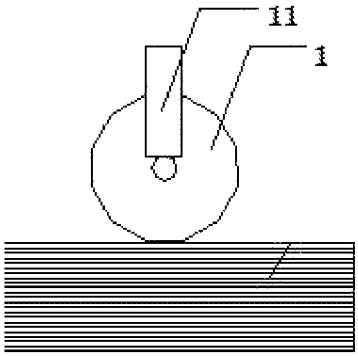
FIG. 1 is a schematic view showing the structure of an example of a device for separating cards in single sheet according to an embodiment of the present application.

Referring to FIG. 1, a device for separating cards in single sheet according to an embodiment of the present application, includes a support frame 4 and a driving shaft 2 which is movably mounted on the support frame 4, a separating wheel 1 being provided on the driving shaft 2. The driving shaft 1 is movable freely up and down along the support frame 4, and an elastic component 11 is provided between the driving shaft 1 and the support frame 4. The elastic component 11 has on end fixed to the support frame 4 and another end mounted on the driving shaft 2, which allows the separating wheel 1 to always keep a downward pressure to cards under the action of an elastic force. It can be understood that the separating wheel 1 is a friction wheel and is further made of rubber materials, the friction wheel and an uppermost card of the multiple stacked cards rub against each other.

Further, the separating wheel 1 described above is driven by the rotation of the driving shaft 2, and a relative rotational gap with a preset angle range is presented between the separating wheel 1 and the driving shaft 2.

The support frame 4 is further provided with a vertical elongated slot in which the driving shaft 1 is movable up and down.

As shown in FIG. 1, in the case that the stacked cards are tilted, the driving shaft 2, under the action of a downward pressure of the elastic component 11, drives the separating wheel sleeved on the driving shaft 2 to press downward to contact with the tilted cards.

In this embodiment, the elastic component 11 in contact with the driving shaft 2 provides the downward pressure to the driving shaft 2, allowing the separating wheel 1 to always keep the downward pressure to the cards under the action of the elastic force, thus achieving the function that an upper surface of the cards is in full contact with the separating wheel 1 all the time when the cards are in any tilted state, thereby addressing the technical issue that sufficient contact between the rubber wheel and cards is difficult to be ensured due to the gap between the rubber wheel and the cards generated when a conventional card separating mechanism separates multiple stacked and tilted cards, and further ensuring the success rate of the card dispensing. Further, the separating wheel is employed to separate cards by means of friction, thereby addressing the technical issue that the surface of the card may be abraded by reciprocate of the scraper in the conventional mechanical card separating mechanism.

Figure 2:
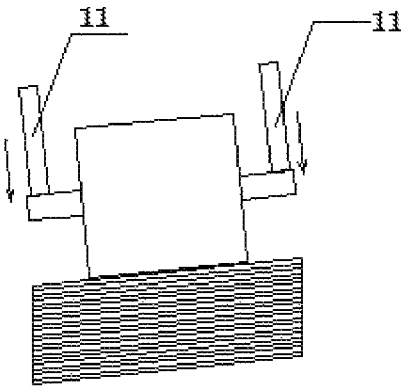
FIG. 2 is a schematic view showing the structure of a device for separating cards in single sheet according to the embodiment of the present application in a tilted state.
Figure 3:
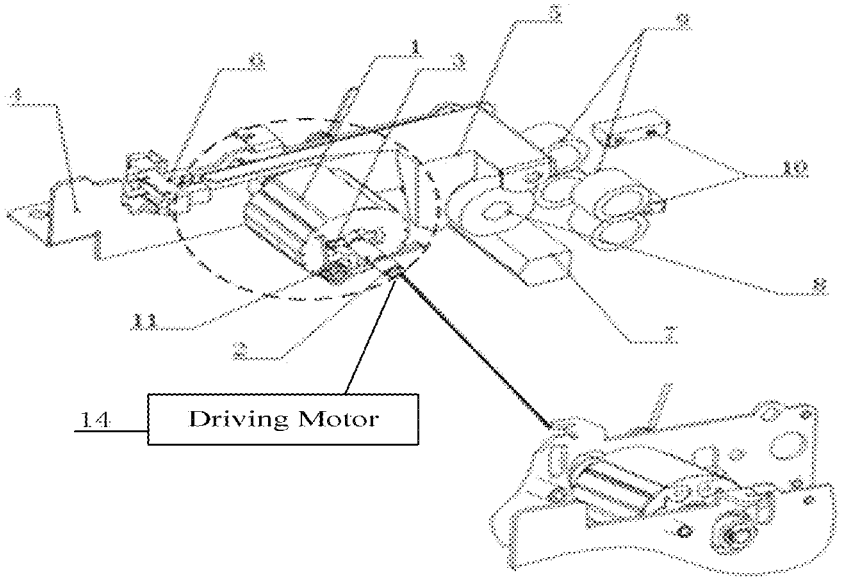
FIG. 3 is a schematic view showing the structure of a card dispensing device according to an embodiment of the present application.

The structure of the device for separating cards in single sheet is described in detail hereinbefore. A card dispensing device including the device for separating cards in single sheet will be described in detail hereinafter. Referring to FIG. 3, an example of the card dispensing device according to an embodiment of the present application includes:

the device for separating cards in single sheet as shown in FIGS. 1 to 3, which includes the support frame 4, the separating wheel 1, the driving shaft and the elastic component 11; and a transmission mechanism including an upper position-limiting component 8 and a lower position-limiting component 7 which are mounted on the support frame 4.

The upper position-limiting component 8 and the lower position-limiting component 7 are vertically opposite to each other, and a card dispensing gap which is larger than a thickness of a single card and smaller than a thickness of two cards is defined between the upper position-limiting component 8 and the lower position-limiting component 7. It is to be noted that, the upper position-limiting component 8 in this embodiment may be fixedly or movably mounted to the support frame 4, and the lower position-limiting component 7 is fixedly or movably mounted to the support frame 4

As shown in FIG. 1, the separating wheel 1 is in contact with the surface of the card all the time, and is held up by the cards to move up and down in a vertical direction. In the case that the cards are horizontal, both ends of the separating wheel 1 are raised up at the same time; and in the case that the cards are tilted, only one end of the separating wheel 1 is raised up.

As shown in FIG. 2, one implementation in which the driving shaft 2 is movable up and down along the support frame 4 is that: the support frame 4 is provided with a vertical elongated slot in which the driving shaft 2 is movable up and down. Of course, other implementations may also be included, which will not be described here.

Further, the card dispensing mechanism according to an embodiment of the present application further includes:

a swing lever 5, which is mounted on the support frame 4, a bottom of the swing lever 5 being in contact with a part, at an inner side of the separating wheel 1, of the driving shaft 2, the swing lever 5 being configured to detect a height position of the stacked cards, and a detecting point of the swing lever 5 being located in a middle position of cards in a direction of the short side of the card;

a first sensor 6, which is mounted in front of the support frame 4, arranged to correspond to a front end of the swing lever 5 and configured to detect a baffle 12 at the front end of the swing lever 5; and a raising component 13 arranged below the stacked cards and is electrically connected to the first sensor 6.

Figure 4:
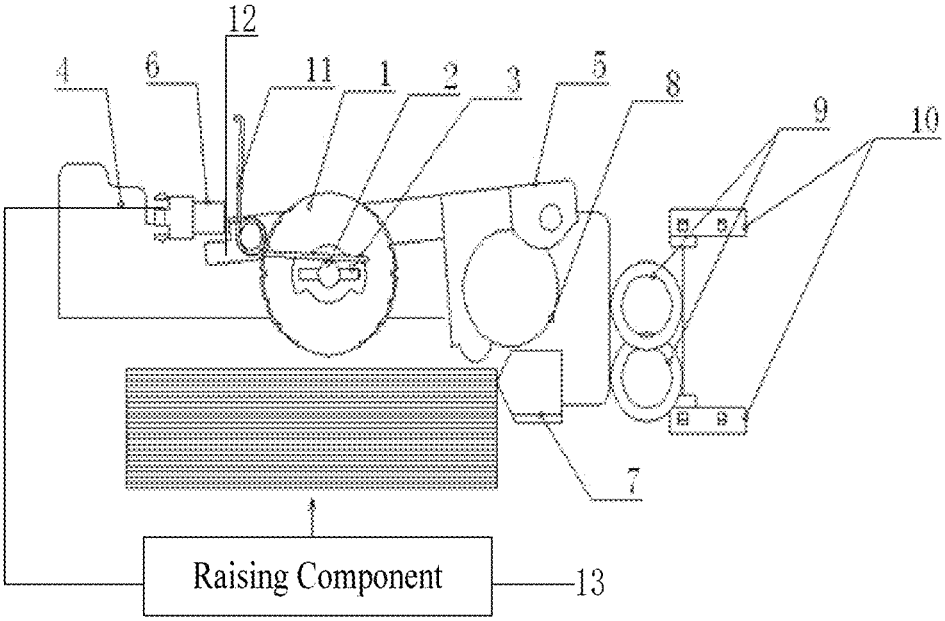
FIG. 4 is a schematic view of the card dispensing device according to the embodiment of the present application when a raising component is in a raising state.

As shown in FIG. 4, in the case that the baffle at the front end of the swing lever 5 is not detected by the first sensor 6, the first sensor 6 sends a signal to the raising component, and the raising component raises the stacked cards to jack the separating wheel 1 and the driving shaft 2 upward. Accordingly, the swing lever 5 is raised up. When the baffle of the swing lever 5 corresponds to the first sensor 6 in position to allow the baffle to be detected by the first sensor 6, the raising component is triggered to stop raising.

Further, the card dispensing device according to an embodiment of the present application further includes:

a conveying mechanism including a pair of conveying wheels 9 mounted on the support frame 4 to be vertically opposite to each other, and a second sensor 10, the second sensor 10 being mounted to the support frame 4 and configured to detect a position of a separated card.

It is to be noted that, when the card dispensing device is started, the driving shaft 2, under the action of the driving motor 14 and the pin 3, drives the separating wheel 1 to horizontally convey, under the action of friction, an uppermost card at the top of the stacked cards forward to the card dispensing gap between the upper position-limiting component 8 and the lower position-limiting component 7. The uppermost card continues to be conveyed forward by the conveying wheels 9, till the second sensor 10 has detected that a tail end of the card leaves, and then the conveying wheels 9 stop rotating. Further, in the case that the subsequent cards are separated in single sheet, operation may be performed in the aforementioned operation manner.

In order to facilitate understanding, the operation process of the card dispensing device in FIGS. 2 and 3 is described in detail below through a specific application scenario, the following application examples are included.

As shown in FIG. 4, in an initial state, a height position of the front end of the card is detected by the sensor 6; in the case that the sensor 6 is not blocked by the baffle of the swing lever 5, the raising component is triggered to raise the hard cards.

Figure 5:
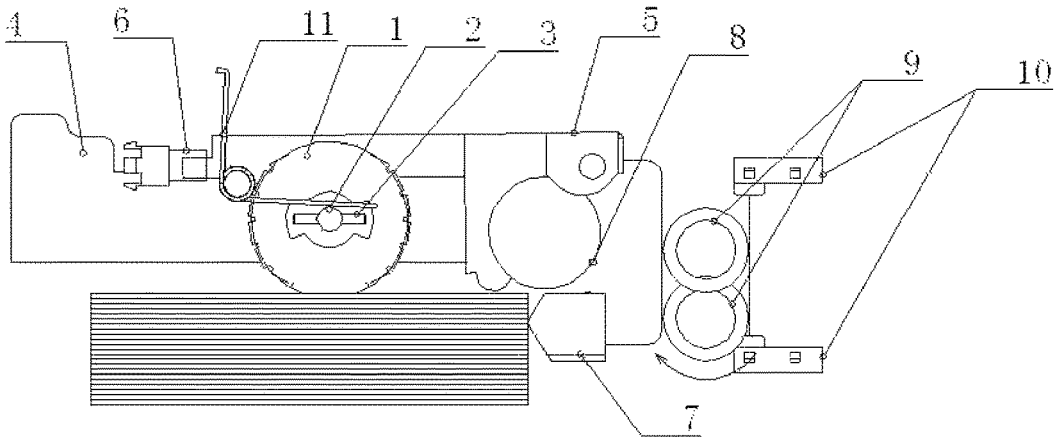
FIG. 5 is a schematic view of the card dispensing device according to the embodiment of the present application in a card pre-dispensing state.

As shown in FIG. 5, in the case that the cards are raised to a position where the first sensor 6 is blocked by the baffle, the raising component stops raising, thus entering a card pre-dispensing state.

Figure 6:
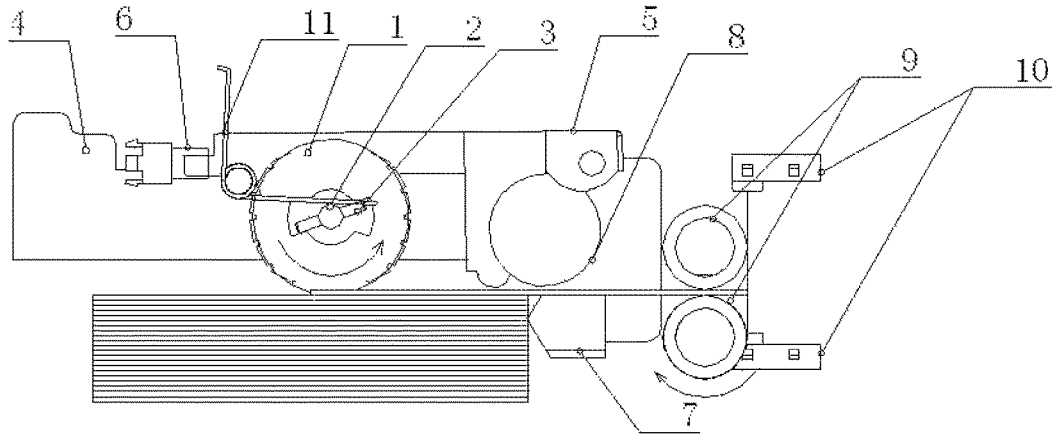
FIG. 6 is a schematic view showing an operation state of the card dispensing device according to the embodiment of the present application, in which state a single card is separated.

As shown in FIG. 6, the separating wheel 1 is controlled to rotate to separate a single card, and the single card passes through the gap between the upper position-limiting component 8 and the lower position-limiting component 7 to reach the conveying wheel 9, and continues to move forward till the card reaches the second sensor 10. At this time, a control program stops driving the friction wheel 1 to rotate, at this moment the conveying wheels driven by the driving motor still rotate.

Figure 7:
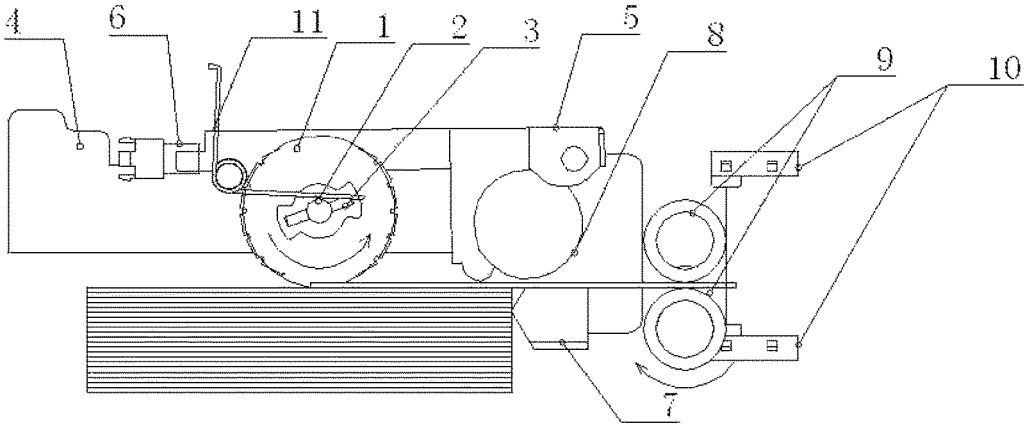
FIG. 7 is a schematic view showing an operation state of the card dispensing device according to the embodiment of the present application, in which state the single card is conveyed to a conveying wheel.

As shown in FIG. 7, at this time, since the separating wheel 1 is still not disengaged from the first card, the separating wheel 1 may be dragged by the first card to rotate till the separating wheel 1 is completely disengaged from the first card. At this time, the separating wheel 1 stops rotating due to lacking power.

Figure 8:
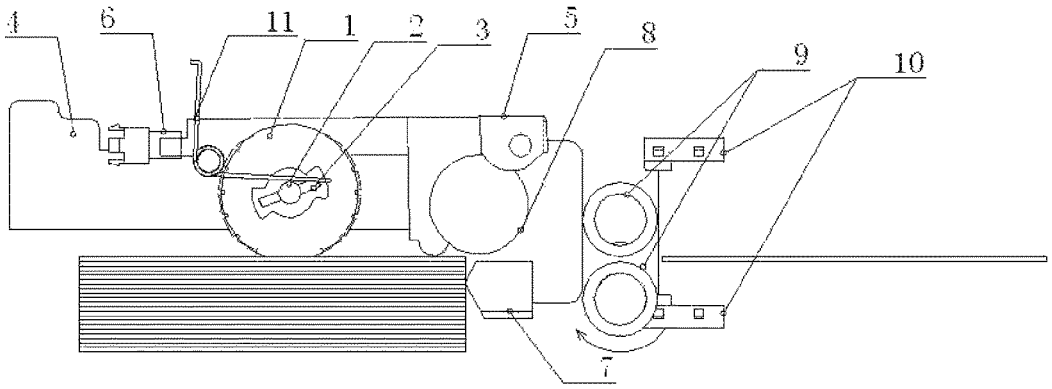
FIG. 8 is a schematic view showing an operation state of the card dispensing device according to the embodiment of the present application, in which state a second sensor is sensing the position of the single card.

As shown in FIG. 8, the first card continues to be conveyed by the conveying wheels 9 till the first card exits from the second sensor 10.

Figure 9:
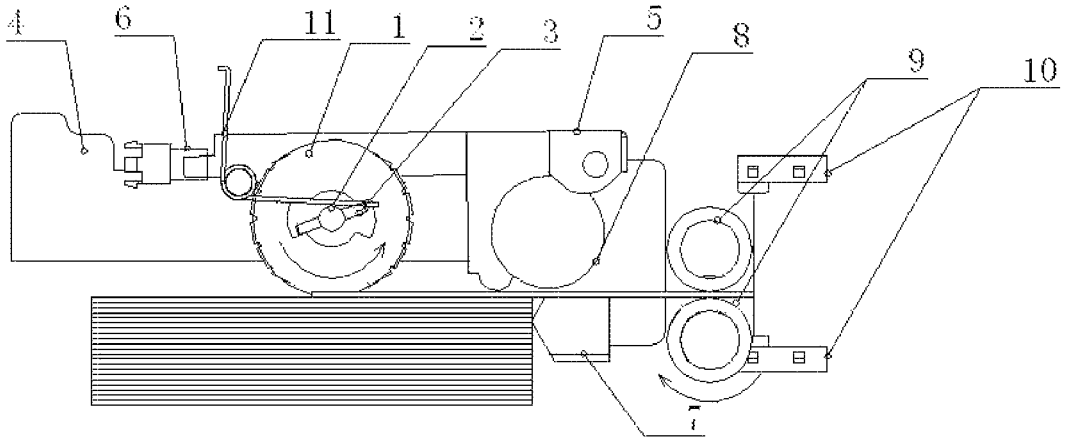
FIG. 9 is a schematic view showing an operation state of the card dispensing device according to the embodiment of the present application after the single card has been separated.

As shown in FIG. 9, after the first card exits from the second sensor 10, the separating wheel 1 is controlled to rotate to separate a second card.

After the cards are separated, the front end of the swing lever 5 is incessantly lowered as the cards are reduced. In the case that the front end of the swing lever 5 is lowered to a position where the baffle at the front end of the swing lever 5 disengages from the first sensor 6, the raising component starts to raise the cards. When the cards are raised such that the baffle of the swing lever 5 can be detected by the first sensor 6 again, the raising component stops raising the cards. At this time, the separating wheel 1 continues to operate to separate the cards out, and the separation operation for the multiple stacked cards is cycled.

In this embodiment, the elastic component 11 in contact with the driving shaft 2 provides the downward pressure to the driving shaft 2, such that the separating wheel 1 always keeps the downward pressure to the cards under the action of the elastic force, thus achieving the function that the upper surface of the cards always keeps in full contact with the separating wheel 1 when the cards are in any tilted state, and addressing the technical issue that sufficient contact between a rubber wheel and cards is difficult to be ensured due to a gap between the rubber wheel and the cards generated when a conventional card separating mechanism separates multiple stacked and tilted cards, and further ensuring the success rate of the card dispensing. Further, the separating wheel is employed to separate cards by means of friction, thus addressing the technical issue that the surface of the card may be abraded by reciprocate of a scraper in the conventional mechanical card separating mechanism. In addition, in the case that the baffle of the swing lever 5 is not detected by the first sensor 6, the raising component is triggered by the first sensor 6 to raise the cards, thus further addressing the technical issue that the separating wheel 1 becomes to rotate idly when the cards are reduced gradually as being separated. Further, with the designs of the upper position-limiting component 8, the lower position-limiting component 7 and the conveying wheels 9, a more stable performance is achieved in the process of the single card separation.

It can be clearly understood by those skilled in the art that, for convenience and concision of the description, the specific operating process of the system, device and unit described above may refer to the corresponding process in the embodiment of the method described above, which will not be described herein again.

The above description and the above embodiments are only intended to illustrate the technical solutions of the present application, and should not be interpreted as a limitation to the technical solutions of the present application. Though the present application has been described in detail with reference to the above embodiments, it should be understood by those skilled in the art that, modifications may be made to the technical solutions described in the various embodiments described above, or equivalent substitutions may be made to a part of the technical features in the above embodiments; and all these modifications or substitutions may not make the essence of the respective technical solutions depart from the spirit and scope of the technical solutions of the embodiments of the present application.

The invention claimed is:

1. A card dispensing device, comprising:

a device for separating cards in single sheets which comprises a support frame, a driving shaft movably mounted on the support frame, and a separating wheel provided on the driving shaft; wherein, the driving shaft is movable freely up and down on the support frame;

an elastic component is provided between the driving shaft and the support frame; and the elastic component has one end fixed to the support frame and another end mounted on the driving shaft, which allows the separating wheel to always keep a downward pressure to cards stacked on the card dispensing device under the action of an elastic force; and the separating wheel is driven by rotation of the driving shaft, and a relative rotational gap with a preset angle range exists between the separating wheel and the driving shaft; and wherein the device for separating cards in single sheets comprises the support frame, the separating wheel, the driving shaft and the elastic component; and a transmission mechanism comprising an upper position-limiting component and a lower position-limiting component which are mounted on the support frame;

wherein the upper position-limiting component and the lower position-limiting component are vertically opposite to each other, and a card dispensing gap which is larger than a thickness of a single card and smaller than a thickness of two cards is defined between the upper position-limiting component and the lower position-limiting component; and wherein the upper position-limiting component is fixedly mounted on the support frame, and the lower position-limiting component is movably mounted on the support frame.

2. The card dispensing device according to claim 1, further comprising:

a swing lever mounted on the support frame and configured to detect a height position of the stacked cards, wherein a detecting point of the swing lever is located in a middle of the stacked cards in a direction of a short side of the stacked cards;

a first sensor mounted in front of the support frame and arranged to correspond to a front end of the swing lever, and is configured to detect a baffle at a front end of the swing lever; and a raising component arranged below the stacked cards and electrically connected to the first sensor.

3. The card dispensing device according to claim 2, wherein in the case that the baffle at the front end of the swing lever is not detected by the first sensor, the raising component is triggered by the first sensor to raise the stacked cards up, till the baffle at the front end of the swing lever is detected by the first sensor, the raising component stops raising.

4. The card dispensing device according to claim 1, further comprising a conveying mechanism comprising a pair of conveying wheels mounted on the support frame to be vertically opposite to each other and a second sensor, wherein the second sensor is mounted on the support frame and is configured to detect a position of a separated card.

5. The card dispensing device according to claim 4, wherein when the card dispensing device is started, the driving shaft, under the action of a driving motor, drives the separating wheel and a pin to horizontally convey, under the action of a friction, an uppermost card at the top of the stacked cards forward to the card dispensing gap between the upper position-limiting component and the lower position-limiting component, and the uppermost card continues to be conveyed forward by the conveying wheels, till leaving of a tail end of the card is detected by the second sensor, the conveying wheels then stop rotating.

6. A card dispensing device, comprising:

a device for separating cards in single sheets, which comprises a support frame, a driving shaft movably mounted on the support frame, and a separating wheel provided on the driving shaft; wherein, the driving shaft is movable freely up and down on the support frame;

an elastic component is provided between the driving shaft and the support frame; and the elastic component has one end fixed to the support frame and another end mounted on the driving shaft, which allows the separating wheel to always keep a downward pressure to cards stacked on the card dispensing device under the action of an elastic force; and the separating wheel is driven by rotation of the driving shaft, and a relative rotational gap with a preset angle range exists between the separating wheel and the driving shaft; and the support frame is provided with a vertical elongated slot in which the driving shaft is moved up and down; wherein the device for separating cards in single sheets comprises the support frame, the separating wheel, the driving shaft and the elastic component; and a transmission mechanism comprising an upper position-limiting component and a lower position-limiting component which are mounted on the support frame;

wherein the upper position-limiting component and the lower position-limiting component are vertically opposite to each other, and a card dispensing gap which is larger than a thickness of a single card and smaller than a thickness of two cards is defined between the upper position-limiting component and the lower position-limiting component; and wherein the upper position-limiting component is fixedly mounted on the support frame, and the lower position-limiting component is movably mounted on the support frame.

7. The card dispensing device according to claim 6, further comprising:

a swing lever mounted on the support frame and configured to detect a height position of the stacked cards, wherein a detecting point of the swing lever is located in a middle of the stacked cards in a direction of a short side of the stacked cards;

a first sensor mounted in front of the support frame and arranged to correspond to a front end of the swing lever, and is configured to detect a baffle at a front end of the swing lever; and a raising component arranged below the stacked cards and electrically connected to the first sensor.

8. The card dispensing device according to claim 6, further comprising a conveying mechanism comprising a pair of conveying wheels mounted on the support frame to be vertically opposite to each other and a second sensor, wherein the second sensor is mounted on the support frame and is configured to detect a position of a separated card.

* * * * *